United States Patent [19]

Gruber

[11] 4,434,817

[45] Mar. 6, 1984

[54] EDGE YARN CLAMP FOR A WEAVING MACHINE

[75] Inventor: Walter Gruber, Constance, Fed. Rep. of Germany

[73] Assignee: Sulzer Brothers Ltd., Winterthur, Switzerland

[21] Appl. No.: 335,453

[22] Filed: Dec. 29, 1981

[30] Foreign Application Priority Data

Feb. 12, 1981 [CH] Switzerland ..... 149/81

[51] Int. Cl.[3] ..... D03D 47/00

[52] U.S. Cl. ..... 139/429; 112/235; 139/194

[58] Field of Search ..... 112/235; 139/429, 448, 139/452, 194, 196.2; 188/65.1, 65.2, 251 A, 251 R; 24/132 R, 133, 134

[56] References Cited

U.S. PATENT DOCUMENTS

| | | | |
|---|---|---|---|
| 1,980,759 | 11/1934 | Kroto | 81/421 |
| 2,389,808 | 11/1945 | Moessinger | 139/194 |
| 2,743,726 | 5/1956 | Grieshaber | 81/421 |
| 3,662,785 | 5/1972 | Kokkinis | 139/448 |
| 4,190,089 | 2/1980 | Cyvas | 139/452 |

*Primary Examiner*—Henry Jaudon

*Attorney, Agent, or Firm*—Kenyon & Kenyon

[57] ABSTRACT

The edge yarn clamp for a weft yarn is provided with a push-on resilient shoe on the metal clamping jaw. The resilient shoe includes a curved clamping cap on a rearward part to reliably retain the shoe in place while permitting an ease of fitting-on.

4 Claims, 3 Drawing Figures

EDGE YARN CLAMP FOR A WEAVING MACHINE

This invention relates to an edge yarn clamp for a weaving machine. More particularly, this invention relates to a yarn clamp for clamping the end of a weft yarn in a weaving machine.

Heretofore, various types of clamps have been used in weaving machines in order to take over the yarn end of a picked weft yarn. Generally, these clamps are intended to maintain the yarn end clamped in a reliable manner as far as the edge of the fabric being woven and to retain the yarn end at that point in order that a selvege needle may start to insert the yarn into the fabric in known manner. Such clamps, as described in Swiss Patent 149,667, generally utilize at least one spring biased reciprocal clamping jaw for the clamping of the yarn end.

However, it has been found that yarn clamps which have spring biased clamping jaws have a disadvantage in that the jaws have had hard clamping surfaces of metal. As a result, there is a risk of damage to the fibrils of delicate yarns which are being woven. Further, these known clamps cannot provide a reliable, that is a totally gapless, clamping zone between the clamping jaw and the yarn. Still further, the metal clamping surfaces wear rapidly and require frequent replacement.

Accordingly, it is an object of the invention to provide a yarn clamp which can be used with delicate yarns.

It is another object of the invention to provide a yarn clamp which does not require frequent replacement due to wear.

It is another object of the invention to provide a reliable clamping zone for a weft yarn end in a weaving machine.

It is another object of the invention to improve existing clamps in order to provide a reliable and delicate clamping of a yarn end while experiencing little wear.

Briefly, the invention provides an edge yarn clamp for a weaving machine which is comprised of at least one spring-biased reciprocally mounted clamping jaw and a push-on resilient shoe mounted on the jaw.

The construction of the yarn clamp is such that yarn clamping becomes substantially gapless and delicate. Further, the only wearing element that requires replacing is the resilient shoe. Hence, operation of the yarn clamp becomes reliable and is not disturbed by appreciable interruptions.

In one advantageous embodiment, the resilient shoe is a clamping shoe. In this case, assembly of the yarn clamp is simplified.

These and other objects and advantages of the invention will become more apparent from the following detailed description taken in conjunction with the accompanying drawings wherein.

Figure 1:
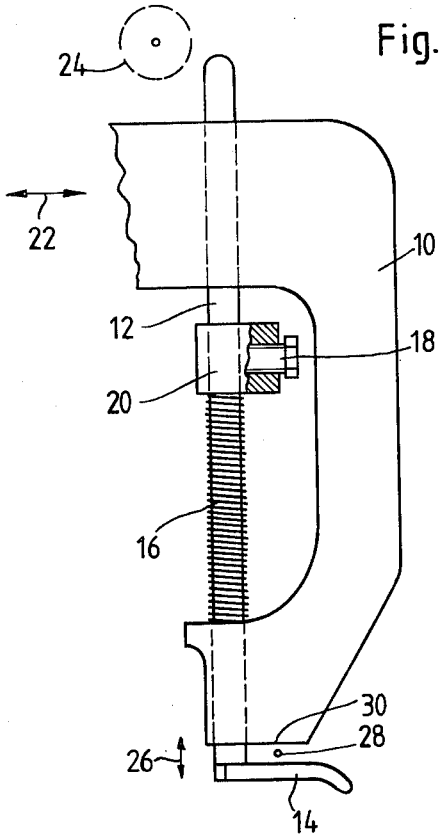
FIG. 1 illustrates a side view of an edge yarn clamp constructed in accordance with the invention.

Referring to FIG. 1, the edge yarn clamp is constructed for use in a weaving machine in order to clamp the end of a weft yarn 28 which has been picked through a shed (not shown). As indicated, the yarn clamp includes a U-shaped holder 10 which is mounted in the weaving machine for reciprocation in the direction indicated by the double arrow 22. The holder 10 has a clamping surface 30 at the lower end, as viewed, and has suitable bores in which a rod 12 is reciprocally mounted. As indicated, the rod 12 carries a clamping jaw 14 at a lower end opposite the clamping surface 30 of the holder 10. In addition, a compression spring 16 is positioned about the rod 12 and is abutted at one end against the holder 10 and at the opposite end against an adjuster 20. This adjuster 20 includes a clamping screw 18 which can be tightened against the rod 12 in order to adjust the position of the adjuster 20 along the rod 12. In this way, the degree of compression of the spring 16 can be changed from time to time.

As shown in FIG. 1, a striking roller 24 is positioned above the holder 10 to abut the rod 12 during movement of the holder 10 in the direction indicated by the arrow 22. In this way, the rod 12 is caused to reciprocate vertically, as viewed, in the direction indicated by the double arrow 26.

Figure 2:
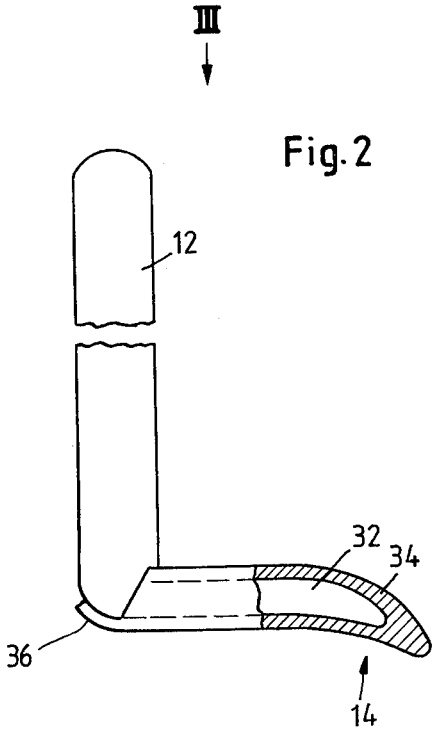
FIG. 2 illustrates an enlarged detailed view of a clamping jaw of the clamp in FIG. 1.
Figure 3:
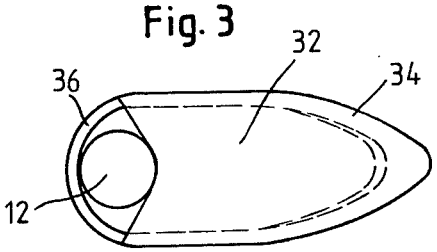
FIG. 3 illustrates a plan view taken in the direction of arrow III of FIG. 2.

Referring to FIGS. 2 and 3, the yarn clamp also includes a push-on resilient shoe 34 made, for example, of an abrasion-resistant elastomer, such as polyurethane, which is disposed on a metal foot or base 32 of the jaw 14. As indicated, the shoe 34 is slidably mounted over the foot 32 and has a curved clamping cap 36 on a rearward part in order to engage against the foot 32. The cap 36 serves to reliably retain the shoe 34 on the foot 32 while allowing an easy fit of the shoe 34 on the foot 32.

As indicated in FIG. 3, the shoe 34 has a generally V-shaped portion which abuts against the vertical rod 12.

During operation, a suitable means (not shown) reciprocates the holder 10 as indicated by the double arrow 22 while the striking roller 24 transmits a vertical movement, as viewed, to the rod 12 so that the rod 12 reciprocates as indicated by the double arrow 26. When in the clamped state, the yarn 28 is clamped and secured between the resilient shoe 34 on the clamping jaw 14 and the clamping surface 30 of the holder 10. Because of the resilient nature of the shoe, a totally gapless clamping zone can be formed for the weft yarn 28. Further, because of the nature of the material of the shoe 34, delicate yarns can be more readily accommodated Of note, should the shoe become worn over a period of time, the shoe may be readily replaced by a new shoe.

What is claimed is:

1. An edge yarn clamp for a weaving machine comprising at least one spring-biased reciprocally mounted clamping jaw having a foot, and a push-on resilient shoe slidably mounted on said foot and having a clamping cap engaged against a rearward part of said foot.

2. An edge yarn clamp as set forth in claim 1 further comprising a holder having a clamping surface thereon and a rod reciprocally mounted in said holder and having said jaw mounted thereon opposite said clamping surface for clamping a weft yarn between said surface and said shoe.

3. An edge yarn clamp for a waving machine comprising at least one spring-biased reciprocally mounted rod having a clamping jaw mounted on an end thereof, said jaw including a metal foot;

a push-on resilient shoe slidably mounted over said foot and having a curved clamping cap on a rearward part to engage against said foot and a V-shaped portion abutting against said rod.

4. An edge yarn clamp for a weaving machine comprising a holder having a clamping surface thereon;

a rod reciprocally mounted in said holder and having a jaw mounted thereon with a foot opposite said clamping surface;

a spring biasing said rod in said holder to move said jaw towards said clamping surface; and a push-on resilient shoe mounted on said foot, said shoe having a curved clamping cap on a rearward part to engage against said foot.

* * * * *